United States Patent [19]

Wiczer

[11] 4,240,634

[45] Dec. 23, 1980

[54] ELASTIC BAND FOR PINBALL GAME

[76] Inventor: Max Wiczer, 9122 Kedvale Ave., Skokie, Ill. 60076

[21] Appl. No.: 3,116

[22] Filed: Jan. 15, 1979

[51] Int. Cl.[3] ..... A63B 71/00

[52] U.S. Cl. ..... 273/127 R

[58] Field of Search ..... 273/127 R, 121 A, 121 R, 273/122 A, 122 R, 123 A, 123 R, 124 A, 124 R, 125 A, 125 R, 126 A, 126 R, 127 A, 4 B, 8, 9; 124/17, 18, 19, 20 B, 21, 22; 267/153; 277/152, 165, 188 R, 188 A; 257/DIG. 1

[56] References Cited

U.S. PATENT DOCUMENTS

| | | | |
|---|---|---|---|
| 2,328,667 | 9/1943 | Nicholaus | 200/52 |
| 2,473,284 | 6/1949 | Knaggs | 277/188 R |
| 2,867,463 | 1/1959 | Snider | 277/188 R |
| 3,279,805 | 10/1966 | Quinson | 277/188 R |

FOREIGN PATENT DOCUMENTS

| | | | |
|---|---|---|---|
| 763186 | 12/1956 | United Kingdom | 277/188 R |

*Primary Examiner*—Richard C. Pinkham
*Assistant Examiner*—T. Brown
*Attorney, Agent, or Firm*—Vogel, Dithmar, Stotland, Stratman & Levy

[57] ABSTRACT

The band is an endless band of one-piece construction which is adapted to be stretched around a set of posts extending upwardly from the playfield board of a pinball game. The band has an annular elastic body having inner and outer annular portions which respectively extend radially inwardly and outwardly of the body, the inner annular portion being adapted to be seated in complementary grooves of the associated posts. First and second annular flange portions extend from the body respectively in opposite directions generally parallel to the axis thereof coaxially therewith for inhibiting passage of the pinball above or beneath the band and to prevent twisting of the band on the associated posts.

5 Claims, 4 Drawing Figures

FIG. 1
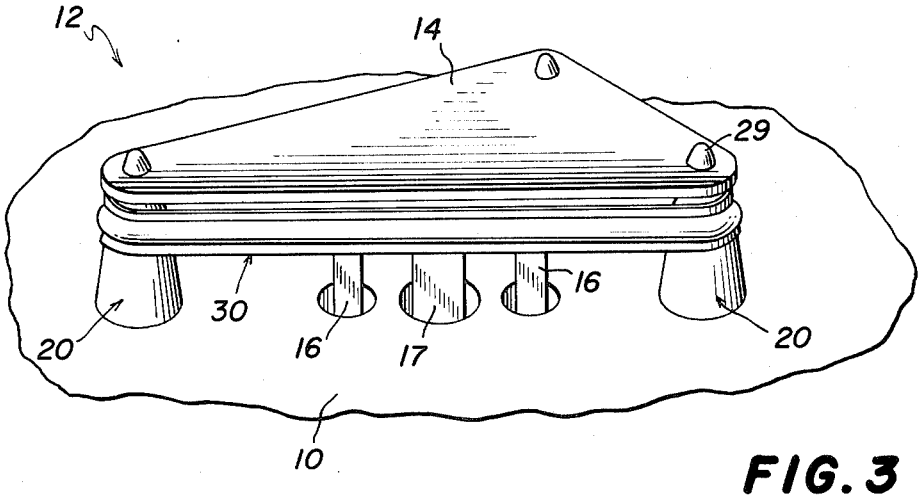
FIG. 2
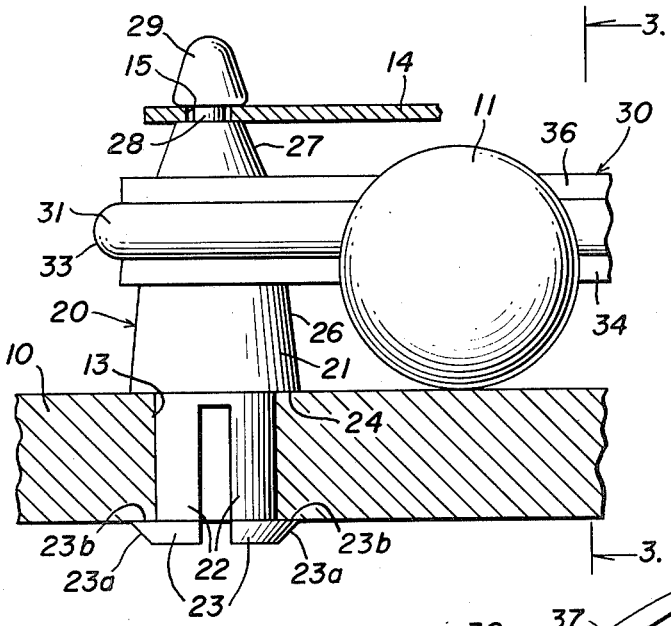
FIG. 3
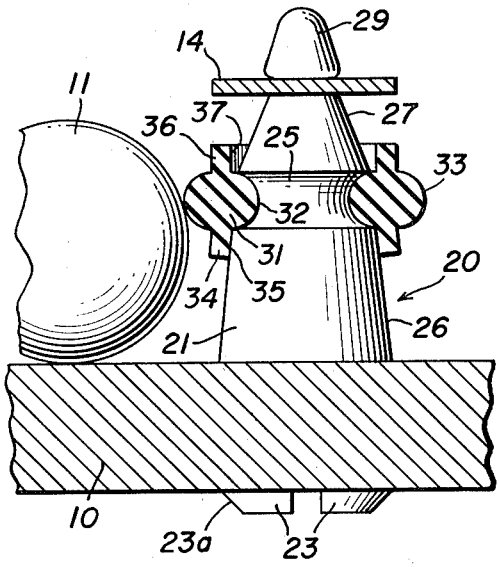
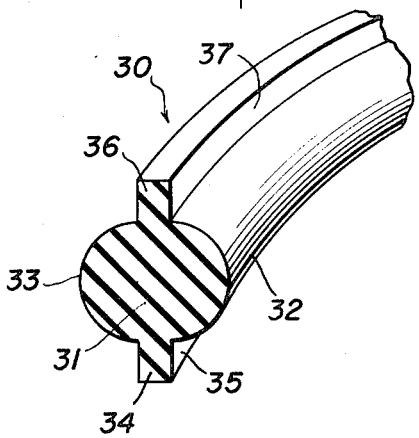
FIG. 4

ELASTIC BAND FOR PINBALL GAME

BACKGROUND OF THE INVENTION

The pinball game has a playfield board and a number of pinballs propelled, usually one after another, onto the board. Located on the board are various kinds of ball objectives and targets which, when struck, register a score. One of these objectives or targets may be an elastic ring or band encircling a set of posts under tension. A switch (or switches) has its blade protruding through an opening in the playfield board and in contact with the elastic band. When the ball strikes the band, the switch is actuated, causing a score to be registered. Also, a kicker device may be associated with the elastic band causing the ball to be rebounded at an increased speed. Usually, a decorative plastic plate is carried by these posts, which may be illuminated when the score is registered.

In the past each such elastic band was an endless onepiece body in the shape of a torus, i.e., substantially circular in transverse cross section. But since the pinball frequently has a considerable amount of "English" on it (i.e., any rotation of the pinball other than a simple forward rolling motion) as it strikes the band, it tends to displace the band in directions other than a simple horizontal deflection inwardly of the band loop. Thus, for example, the pinball might have underspin or overspin which would, respectively, tend to deflect the band upwardly or downwardly. This sometimes results in the pinball squeezing beneath the band or passing over the band, resulting in jamming of or damage to the machine. Furthermore, these prior art bands may become twisted during mounting on the posts since the toroidal shape of the band makes it difficult to tell whether the band is twisted. Such twisting tends to increase the "English" on the pinball when it rebounds from the elastic band.

SUMMARY OF THE INVENTION

It is, therefore, an important object of the present invention to provide an endless elastic band for use in a pinball game which tends to inhibit unintended deflections of the band by the pinball in use.

More particularly, it is an object of this invention to provide an elastic band which will inhibit the passage of the pinball beneath or over the band in use.

Yet another object of the invention is to provide an elastic band of the character described which may be simply and easily installed, without twisting of the band on the associated posts.

In summary, there is provided an endless elastic band for use in a pinball game to encircle under tension a set of annularly grooved posts which project upwardly from a playfield board supporting a rolling pinball thereon, said band comprising an annular elastic body having an axis extending through the center thereof normal to the radii thereof, an inner annular portion on said body extending radially inwardly thereof and being shaped and dimensioned for seating in the annular grooves of the associated posts, and an annular flange portion on said body extending therefrom generally in the direction of said axis coaxially therewith, said band being adaptable for encircling the associated set of posts under tension with said inner annular portion seated in the grooves of the associated posts and with said flange portion extending downwardly along the posts toward the playfield board, whereby said flange serves to inhibit twisting of said band and passage of the associated pinball beneath said band.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purposes of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a perspective view of a slingshot apparatus on a fragmentary portion of a playfield board in a pinball game, such apparatus including an elastic band incorporating the features of the present invention;

FIG. 2 is an enlarged fragmentary view in elevation of a portion of the elastic band wrapped around one of the posts of the apparatus of FIG. 1, and illustrating a pinball in engagement with the band;

FIG. 3 is a fragmentary view in vertical section, taken along the line 3—3 in FIG. 2; and FIG. 4 is a further enlarged fragmentary perspective view of a portion of the elastic band of the present invention, illustrating the transverse cross section thereof.

DESCRIPTION OF THE PREFERRED EMBODIMENT

Turning now to FIG. 1 of the drawings, there is shown a playfield board 10 of a pinball game. Carried on the playfield board 10 are a number of targets which, when struck by a pinball 11 (FIGS. 2 and 3), will register a score. One of these targets is depicted in FIG. 1 and may be characterized as a kicker or slingshot apparatus 12. It comprises a set of three posts 20, only two of which are shown. East post is mounted in an opening 13 (FIG. 2) in the board 10. Wrapped around the posts 20 is an endless elastic ring or band 30, which will be described in greater detail below. The posts 20 carry a cover plate 14 which may be formed of plastic and is usually imprinted with decoration. The plate 14 is preferably at least semitransparent so that a lamp (not shown) beneath it, when illuminated, will enhance the decoration imprinted on the cover plate 14. The plate 14 has a plurality of holes 15 (FIG. 2) therein.

The particular apparatus 12 illustrated in FIG. 1 has associated therewith a pair of switches respectively with switch blades 16 protruding through the playfield board 10, the switches themselves being mounted beneath the board. The blades 16 are in contact with the elastic band 30 so that when a pinball 11 strikes the band, the blades 16 are caused to shift, actuating the switch, which in turn causes a score to be registered. The switches associated with the blades 16 cause actuation of a solenoid (not shown) also beneath the playfield board 10 which pivots an arm 17 forcefully into the elastic band 30, causing the pinball 11 to be rebounded at increased speed.

A pinball game may have one or more apparatuses 12 like that shown in FIG. 1. In addition, other apparatuses may incorporate two or more of the posts 20, an elastic band 30, a plate 14 (perhaps of different shape), and one or more switches; it may or may not have an arm 17. Also, each apparatus may include a lamp beneath the cover plate 14 for illumination thereof when the apparatus is impinged by the pinball.

Referring now to FIGS. 2 and 3, each of the posts 20 includes a body portion 21 and a set of four legs 22, each carrying a laterally protruding foot 23. The outer end of each foot 23 is bevelled to define a guide surface 23*a*.

The lower end of the body 21 has a diameter greater than the diameter of the legs 22 so as to define a shoulder 24 adapted to rest on the upper surface of the playfield board 10. The protruding portion of each foot 23 has a laterally extending surface 23*b* disposed generally parallel to the shoulder 24 and spaced therefrom, preferably an amount substantially equal to the thickness of the playfield board 10.

To mount the post 20, its legs 22 are urged toward one another, thereby reducing the effective diameter of the legs to a point corresponding to the diameter of the opening 13 in the playfield board 10. The guide surfaces 23*a* help to guide the legs 22 into the opening 13. The post 20 is pushed down until the shoulder 24 lies against the top surface of the playfield board 10, at which point the feet 23 will have returned to their rest position, and the surfaces 23*b* are disposed beneath the playfield board 10.

Formed in the outer surface of the body portion 21 of the post 20 intermediate the ends thereof is an annular groove 25, generally semicircular in transverse cross section, the groove 25 serving to divide the body portion 21 into a lower portion having a relatively large diameter frustoconical outer surface 26 and an upper portion having a relatively small diameter and more steeply inclined frustoconical outer surface 27. After the posts 20 have been mounted on the playfield board 10, the elastic band 30 is tensioned around the set of posts 20 of the apparatus 12 in a manner which will be described more fully below.

The post 20 includes at the end opposite the legs 22, an upstanding lug 28 which has a diameter less than the diameter of each hole 15 in the cover plate 14. The lug 28 carries fastening structure comprising three annular rings or ridges (not shown) for use in frictionally engaging a cap nut 29. After the cover plate 14 is dropped into position, the cap nut 29 is pushed onto the lug 28 and is held thereon by the ridges.

Referring now also to FIG. 4 of the drawings, the elastic band 30 comprises an endless band of one-piece construction, preferably formed of rubber, although it will be understood that other elastic materials could be used. The elastic band 30 includes an annular body 31 having an inner annular portion 32 which projects radially inwardly of the body 31 and is substantially semicircular in transverse cross section, and an outer annular portion 33 which projects radially outwardly of the body 31 and is also substantially semicircular in transverse cross section. The annulus formed by the body 31 in its untensioned state has an axis which extends through the center thereof substantially normal to the radii thereof. The inner annular portion 32 is shaped and dimensioned to seat snugly in the grooves 25 of the posts 20 when the elastic band 30 is stretched around the set of posts 20 of an apparatus such as the apparatus 12. Preferably, all of the posts 20 of such an apparatus are identical in size and shape, so that the loop of the elastic band 30 will lie in a plane substantially parallel to the playfield board 10 and spaced thereabove a distance less than the diameter of the pinball 11, and preferably generally on the order of the radius of the pinball 11. Respectively extending from the body 31 in opposite directions substantially parallel to the axis thereof and coaxially therewith are annular flange portions 34 and 36, each of which is substantially rectangular in transverse cross section. The flange portions 34 and 36 are respectively provided with substantially coplanar cylindrical inner surfaces 35 and 37.

In use, the elastic band 30 is stretched around a set of posts 20, with the inner annular portion 32 seated in the grooves 25, one of the flange portions (36 in the drawings) being directed upwardly toward the top of the associated posts 20, and the other flange portion (34 in the drawings) being directed downwardly toward the playfield board 10, with the inner cylindrical surface thereof (35 in the drawings) disposed snugly in engagement with the lower outer surfaces 26 of the posts 20.

It will be appreciated that in use the flange portions 34 and 36 of the elastic band 30 effectively extend the vertical dimensions of the elastic band 30 so as more effectively to inhibit passage of a pinball 11 beneath or above the elastic band 30. Also, the cooperation of the flange portions 34 and 36, and particularly the lower one thereof, with the outer surfaces of the associated posts 20 will serve to prevent twisting of the elastic band 30, and will make it readily apparent if the elastic band 30 becomes twisted during the installation thereof.

In the preferred embodiment, the elastic band 30 is substantially symmetrical with respect to a plane P (FIG. 4) normal to the axis of the band. Also, the elastic band 30 has a transverse cross section which is uniform throughout its length and which, in the untensioned condition of the band, is substantially symmetrical with repsect to a line L (FIG. 4) parallel to the axis of the band. This symmetrical construction simplifies installation of the elastic band 30, since it makes no difference which of the flange portions 34 or 36 is directed downwardly. Also, it would make no difference if the elastic band 30 should be twisted inside out so that the positions of the inner and outer annular portions 32 and 33 are reversed, since either one will fit within the post grooves 25.

What has been described, therefore, is an improved elastic band for a pinball game which can be simply and easily installed, regardless of its orientation, and which is provided with flange portions which are respectively directed upwardly and downwardly in use to prevent twisting of the band during installation and to inhibit passage of the pinball beneath or above the band in use.

What is claimed is:

1. In a pinball game having a playfield board supporting a rolling pinball thereon, wherein the improvement comprises: a set of annularly grooved posts adapted to project upwardly from the associated playfield board; and an endless elastic band encircling said set of posts under tension, said band including an annular elastic body having an axis extending through the center thereof normal to the radii thereof, an inner annular portion on said body extending radially inwardly thereof and seated in the annular grooves of said posts, and an annular flange portion on said body extending therefrom generally in the direction of said axis coaxially therewith, said flange portion extending downwardly along said posts toward the associated playfield board, whereby said flange serves to inhibit twisting of said band and passage of an associated pinball beneath said band.

2. The combination of claim 1, wherein said band has a transverse cross section which is uniform throughout the length thereof, said transverse cross section being substantially bilaterally symmetrical with respect to an imaginary line parallel to said axis.

3. The combination of claim 1, wherein said band includes first and second annular flange portions respectively extending from said body in opposite directions generally parallel to said axis thereof coaxially therewith.

4. The combination of claim 3, wherein each of said first and second annular flange portions has an inner cylindrical surface disposed substantially parallel to said axis for engagement with the outer surfaces of said posts.

5. The combination of claim 3, wherein said band is substantially symmetrical with respect to a plane normal to said axis.

* * * * *